US005295438A

United States Patent [19]

Hill et al.

[11] Patent Number: 5,295,438

[45] Date of Patent: Mar. 22, 1994

[54] SINGLE INITIATE COMMAND SYSTEM AND METHOD FOR A MULTI-SHOT BLAST

[75] Inventors: Trevor R. Hill, Cape Town, South Africa; Antony J. Surtees, Hobart, Australia; Mark D. Chewins, Cape Town, South Africa; Andrew J. Houliston, Cape Town, South Africa; Ari Zagnoev, Cape Town, South Africa

[73] Assignee: Plessey Tellumat South Africa Limited, Cape Town, South Africa

[21] Appl. No.: 985,560

[22] Filed: Dec. 3, 1992

[30] Foreign Application Priority Data

Dec. 3, 1991 [ZA] South Africa ..... 91/9508

[51] Int. Cl.[5] ..... F23Q 21/00

[52] U.S. Cl. ..... 102/217; 102/215

[58] Field of Search ..... 102/200, 217, 215; 361/248, 251

[56] References Cited

U.S. PATENT DOCUMENTS

| | | | |
|---|---|---|---|
| Re. 32,888 | 3/1989 | Kirby et al. | 102/217 |
| 4,136,617 | 1/1979 | Fowler | 102/220 |
| 4,537,131 | 8/1985 | Saunders | 102/217 |
| 4,615,268 | 10/1986 | Nakano et al. | 102/217 |
| 4,632,031 | 12/1986 | Jarrott et al. | 102/200 |
| 4,674,047 | 6/1987 | Tyler et al. | 364/423 |
| 4,848,232 | 7/1989 | Kurokawa et al. | 102/200 |
| 5,014,622 | 5/1991 | Jullian | 102/312 |
| 5,214,236 | 5/1993 | Murphy et al. | 102/217 |

FOREIGN PATENT DOCUMENTS 2397246 11/1976 France .

*Primary Examiner*—Ian J. Lobo

*Attorney, Agent, or Firm*—Merchant & Gould, Smith, Edell, Welter & Schmidt

[57] ABSTRACT

Apparatus for timing and initiating a multi-shot blast is disclosed and claimed. The apparatus comprises a programming tool 16 for individually programming a plurality of electronic detonator arrangements 18.1 to 18.5 with delay time data relative to a common initiate command signal. The programmed electronic detonator arrangements 18.1 to 18.5 are all connected to a data communication cable 28 connected to a control unit 20. The control unit transmits the initiate command signal to all the detonator arrangements on the cable 28. Upon reception of the initiate command signal, the detonator arrangements start timing out their respective programmed delay times to cause their associated charges 12.1 to 12.5 to explode at the end of the delay times. The blast may be aborted by a disarm command on the cable 28 at any time before the initiate command signal is transmitted on the cable.

26 Claims, 6 Drawing Sheets

SINGLE INITIATE COMMAND SYSTEM AND METHOD FOR A MULTI-SHOT BLAST

INTRODUCTION AND BACKGROUND

This invention relates to multiple shot blasting systems.

In the specification of the Applicant's U.S. Pat. No. 5,214,236 entitled: "Timing of a multi-shot blast", there is disclosed novel apparatus and a method of timing a multi-shot blast.

According to the method disclosed in the above specification, each charge is fired or initiated individually by loading, via a dedicated path established between a transportable firing or programming tool and each detonator arrangement individually, one after the other, data regarding the time on which the charge associated with that detonator arrangement must explode. Upon reception of the time data, each detonator arrangement starts separately and independently to process the time data, thereby to cause its associated charge to explode when, according to a clock in the detonator arrangement, that charge must explode.

Thus, after the charges have been so initiated, the only way in which the blast can be aborted, is to physically re-establish the path between the firing tool and each detonator arrangement individually, one after the other, and to communicate an "abort"-command to the detonator arrangements. This method and apparatus may not be suitable for some applications.

OBJECT OF THE INVENTION

Accordingly it is an object of the present invention to provide an alternative method and apparatus for initiating and timing a multi-shot blast.

SUMMARY OF THE INVENTION

According to the invention there is provided a method of timing and initiating a multi-shot blast using apparatus comprising a transportable electronic programming tool including data processing circuitry and memory circuitry, and a plurality of explosive charges, each said charge including an electronic detonator arrangement comprising timing means, memory circuitry and data processing circuitry; the programming tool and each said electronic detonator arrangement being provided with means via which a data communication path can be established between the programming tool and any one selected electronic detonator arrangement of said electronic detonator arrangements at a time, the method comprising the steps of:

preparing and positioning said plurality of explosive charges at a blast site;

loading into and storing in the memory circuitry of the programming tool data regarding a desired explosion time for each charge of said plurality of charges, the data regarding a desired explosion time comprising data regarding a delay time relative to an initiate command signal;

physically transporting the programming tool to each said charge;

establishing a data communication path between the programming tool and each said detonator arrangement individually, one after the other;

while the data communication path is established between the programming tool and a selected electronic detonator arrangement of said electronic detonator arrangements, programming the selected electronic detonator arrangement by loading time data comprising data regarding a delay time relative to the initiate command signal that will cause the electronic detonator arrangement to detonate the charge at the desired explosion time associated with that charge from the programming tool into the electronic detonator arrangement and storing said time data in the memory circuitry of the electronic detonator arrangement;

communicating a common initiate command signal to all of said electronic detonator arrangements; and causing each of said electronic detonator arrangements, in response to said initiate command signal, to commence processing the delay time data relative to the initiate command signal stored in its memory circuitry and to cause its associated charge to explode when, according to the electronic detonator arrangement's timing means and the delay time data the charge must explode.

The data regarding a desired explosion time may comprise only data regarding a delay time relative to the common initiate command signal or it may also comprise data regarding other delay times that may, in use, be timed out before the communication of the common initiate command signal.

According to another aspect of the invention there is provided apparatus for timing and initiating a plurality of explosive charges comprising:

a transportable electronic programming tool comprising data processing circuitry, memory circuitry and control circuitry, the tool being programmable to receive time data regarding desired times, at which the charges must explode;

a plurality of electronic detonator arrangements, including one electronic detonator arrangement for each charge of said plurality of charges;

said programming tool and said plurality of electronic detonator arrangements being adapted so that a data communication path may be established between the programming tool and each electronic detonator arrangement of said plurality of electronic detonator arrangements individually, one after the other, for programming each electronic detonator arrangement by transferring from the programming tool to the selected electronic detonator arrangement time data regarding the desired time at which the selected electronic detonator arrangement must detonate its associated charge;

means for communicating a common initiate command signal to all of said electronic detonator arrangements; and each said electronic detonator arrangement comprising data processing circuitry, memory circuitry for storing the time data received from the programming tool, control circuitry and timing means; in use, each said detonator arrangement, after reception of said initiate command signal, being self-contained and adapted to detonate its associated charge when, according to the time data stored in its memory circuitry and its timing means, the charge must explode.

Also included within the scope of the present invention is an electric detonator arrangement as herein described.

BRIEF DESCRIPTION OF THE DRAWINGS

The invention will now further be described, by way of example only, with reference to the accompanying diagrams wherein.

DESCRIPTION OF PREFERRED EMBODIMENTS OF THE INVENTION

Figure 1:
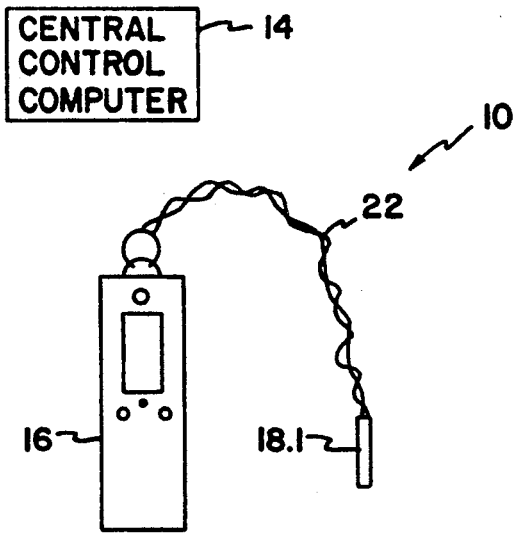
FIG. 1 is a schematic block diagram of part of a first embodiment of the apparatus according to the invention for timing and initiating a plurality of explosive charges.
Figure 2:
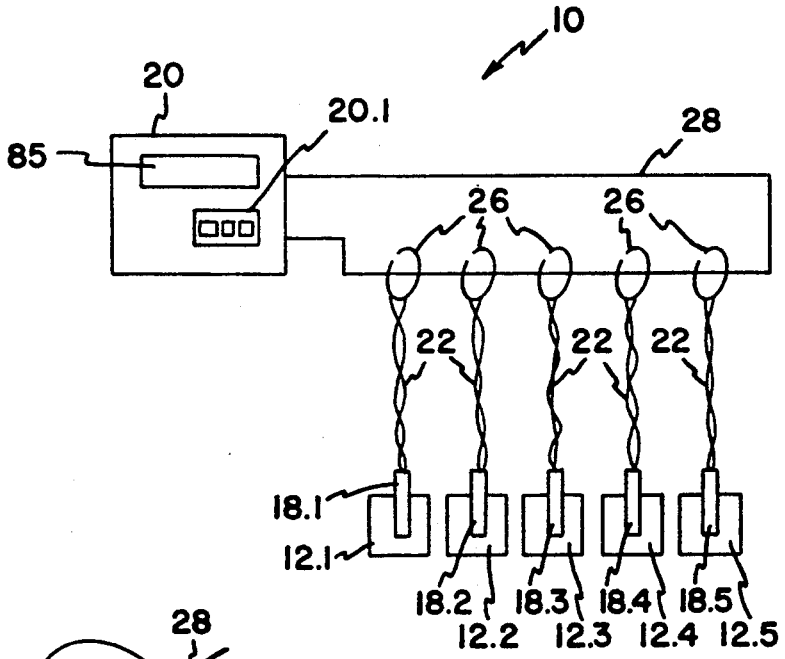
FIG. 2 is a schematic block diagram of the remainder of the apparatus in FIG. 1.

A first embodiment of apparatus according to the invention for timing and initiating a multi-shot blast to be caused by a plurality of explosive charges 12.1 to 12.5, is generally designated by the reference numeral 10 in FIGS. 1 and 2.

The apparatus 10 comprises a central control computer 14 situated at a control station. Computer 14 is a general purpose computer running application specific software. This software enables a control station operator to enter into the control computer 14 mission control data such as delay times, relative to a common INITIATE-command signal, associated with each of the charges 12.1 to 12.5 which will cause the blast as well as blast identification data, which will be described in more detail hereinafter.

The apparatus 10 also comprises a transportable, programmable programming tool 16, a plurality of similar electronic detonator arrangements 18.1 to 18.5, one each to be associated with each of the charges 12.1 to 12.5, a control unit 20 and a control loop 28.

Figure 3:
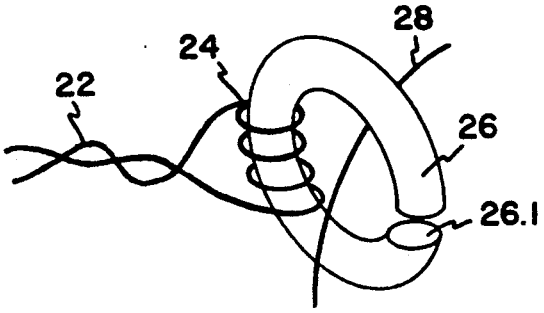
FIG. 3 is a diagrammatic perspective view illustrating how a C-shaped core forming part of an electronic detonator arrangement is coupled to a conductor loop.

To the communications interface 40 (shown in FIG. 6) of each detonator arrangement 18.1 to 18.5 there is connected (as best shown in FIGS. 2 and 3) a pair of twisted conductors 22, about 120 cm in length and terminating in a coil 24 wound on a C-shaped core 26.

In use, and as will be described in more detail hereinafter, conductor 28 is arranged in a loop along the blast site where the explosive charges 12.1 to 12.5 are positioned and is connected to control unit 20.

Figure 6:
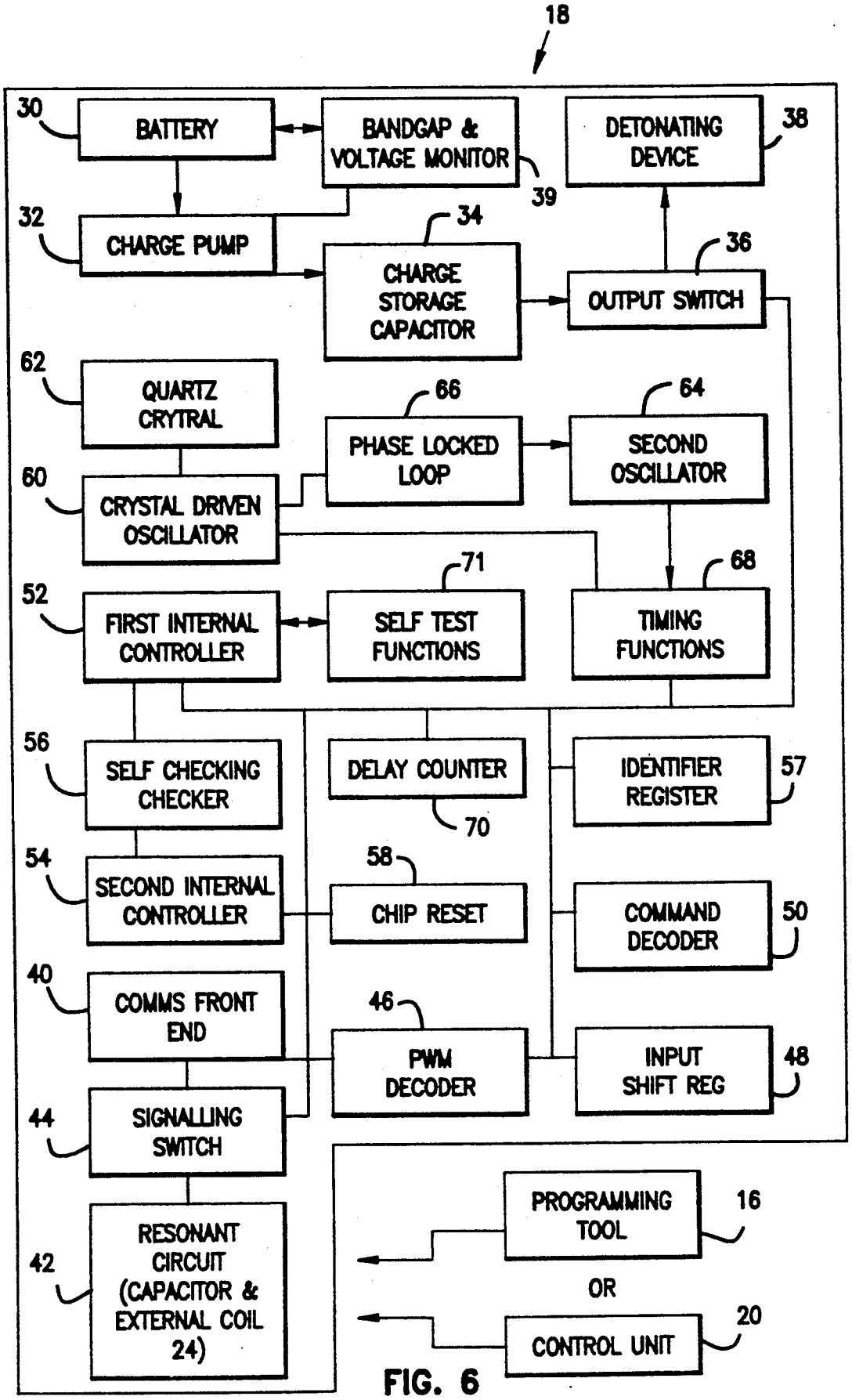
FIG. 6 is a block diagram of an electronic detonator arrangement forming part of the apparatus according to the invention.

A block diagram of detonator arrangement 18.1 is shown in FIG. 6. The detonator arrangement is implemented in the form of a CMOS application specific integrated circuit (ASIC), except for the parts indicated in FIG. 6. The detonator arrangement comprises a power supply 30 comprising two serially connected 1.5 V batteries and a charge pump 32, for charging a charge storage firing capacitor 34 to at least 10 V. An output switch 36 is connected between firing capacitor 34 and a detonating device in the form of a semi-conductor bridge (SCB) 38. A bandgap and voltage monitor 39 provides bias current for analogue circuits in the ASIC and monitors the battery voltage. The voltage monitor disables the charge pump 32 if the battery voltage falls to below a predetermined minimum voltage.

The detonator arrangement 18.1 further comprises a communications interface 40 for bi-directional communications with the programming tool 16 and for receiving incoming communications from control unit 20. The interface 40 comprises a parallel tuned resonant circuit 42 comprising the external coil 24 and a discrete capacitor.

For effecting data communication between the programming tool and the detonator arrangement, the programming tool induces a signal having a sinusoidal waveform and a frequency of between 100 Khz and 300 KHz in the resonant circuit. This signal is keyed on and off by the programming tool 16 or controller 52 (as the case may be), thereby to pulse width modulate the signal with data. For data communication from the detonator arrangement 18.1 to the programming tool 16, signalling switch 44 of the detonator arrangement switches a load of less than 600 ohms across the resonant circuit.

A pulse width modulation (PWM) decoder 46 decodes the received modulated signals and communicates the decoded data to input shift register 48 and command decoder 50. The input shift register provides a store for decoded data during data reception, command identification and checksum comparison. The command decoder 50 distinguishes between the following commands PROGRAM, TEST, PRIME, INITIATE and DISARM. The command decoder then communicates the relevant command to first internal controller 52 and second internal controller 54.

First internal controller 52 controls the time sequential behavior of the detonator arrangement 18.1 and its transition from one state to another, as will hereinafter be described with reference to FIG. 9. Second internal controller 54 mimics first internal controller 52 to provide fail safe behaviour. Self checking checker means 56 checks that the first and second internal controllers agree at all times and also checks itself. If a fault should occur, the charge pump 32 and output switch 36 are disabled. The state vectors of second internal controller 54 are the bitwise inverse of that of first internal controller 52.

Identifier register 57 provides a store for a blast identifying number. This number ensures that a programmed detonator arrangement can only be initiated by a predetermined control unit 20.

The chip reset means 58 ensures that the ASIC resets to the STORAGE-state (shown in FIG. 9) during power up.

Clock signals are provided by a quartz crystal stabilized oscillator 60 connected to quartz crystal 62 and a second oscillator 64 comprising a RC network, phase locked to the crystal stabilized oscillator by phase locked loop 66. The crystal stabilized oscillator provides the time base for timing function means 68, except for during a last predetermined period, starting a predetermined time tp, before the charge is due to explode, when the time base is provided by the second oscillator. The reason for this is that the crystal 62 may become non-functional or the frequency may be disturbed by nearby explosions. The second oscillator also provides clocking signals for the analog circuits, such as the charge pump.

Delay counter 70 times out a delay time, relative to a common INITIATE-command, for the detonator arrangement. Data relating to the delay time together with data relating to a blast identification number is programmed into the detonator arrangement as will be described hereinafter.

The self test means 71 implement a self test sequence for performing diagnostic tests on the ASIC, in response to a TEST-command received via communications interface 40.

Figure 7:
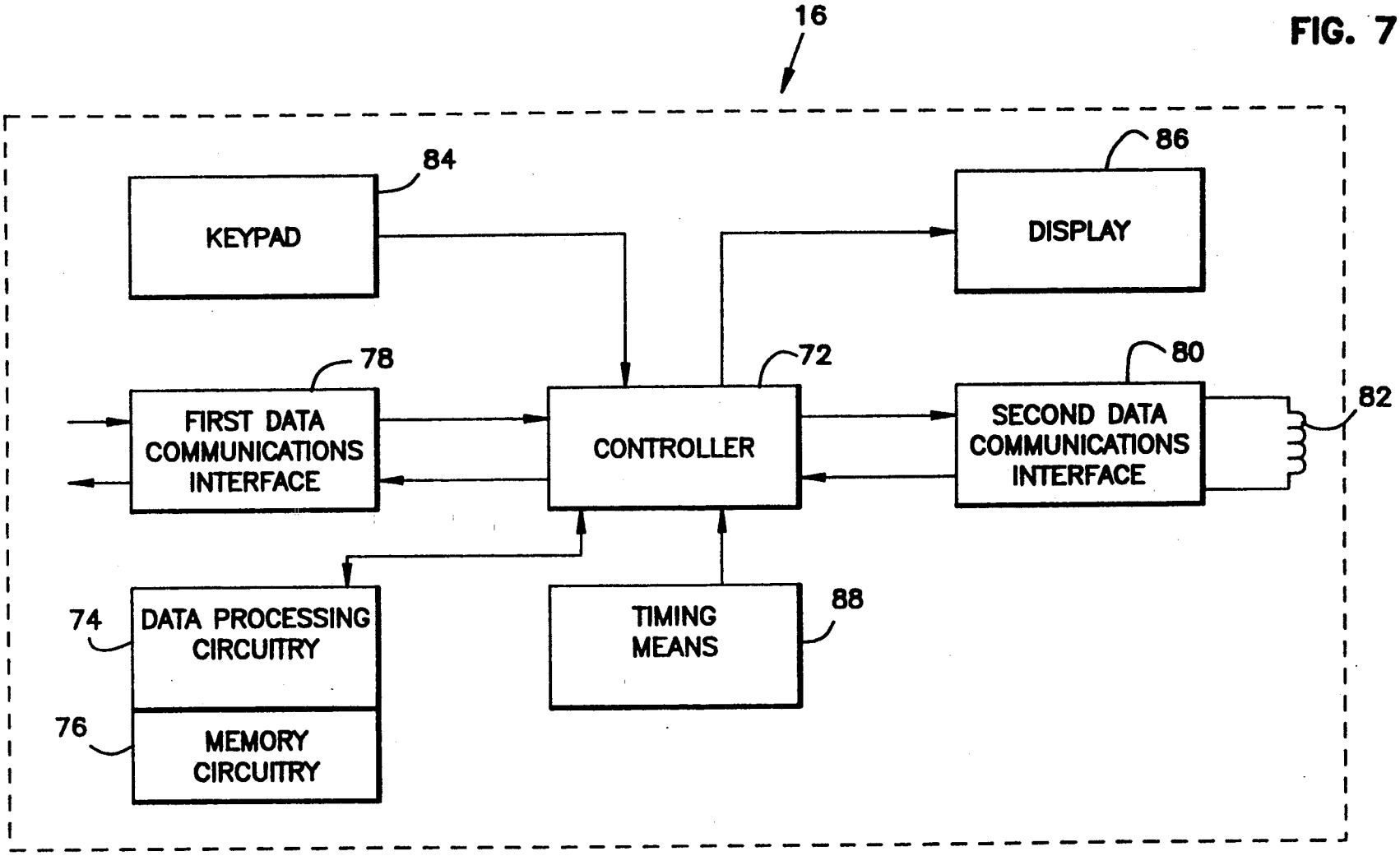
FIG. 7 is a block diagram of a programming tool forming part of the apparatus according to the invention.

In FIG. 7, there is shown a block diagram of programming tool 16. The programming tool 16 comprises a controller 72, data processing circuitry 74 and associated memory circuitry 76. A first data communication interface 78 connectable to the central control computer 14 is connected to controller 72. Also connected to controller 72 is a second data communication interface 80 with coil 82, which, in use, is inductively connectable to the coil 24 of the electronic detonator arrangements 18.1 to 18.5. A keypad 84, display 86 and timing means 88 is also connected to the controller 72.

Figure 8:
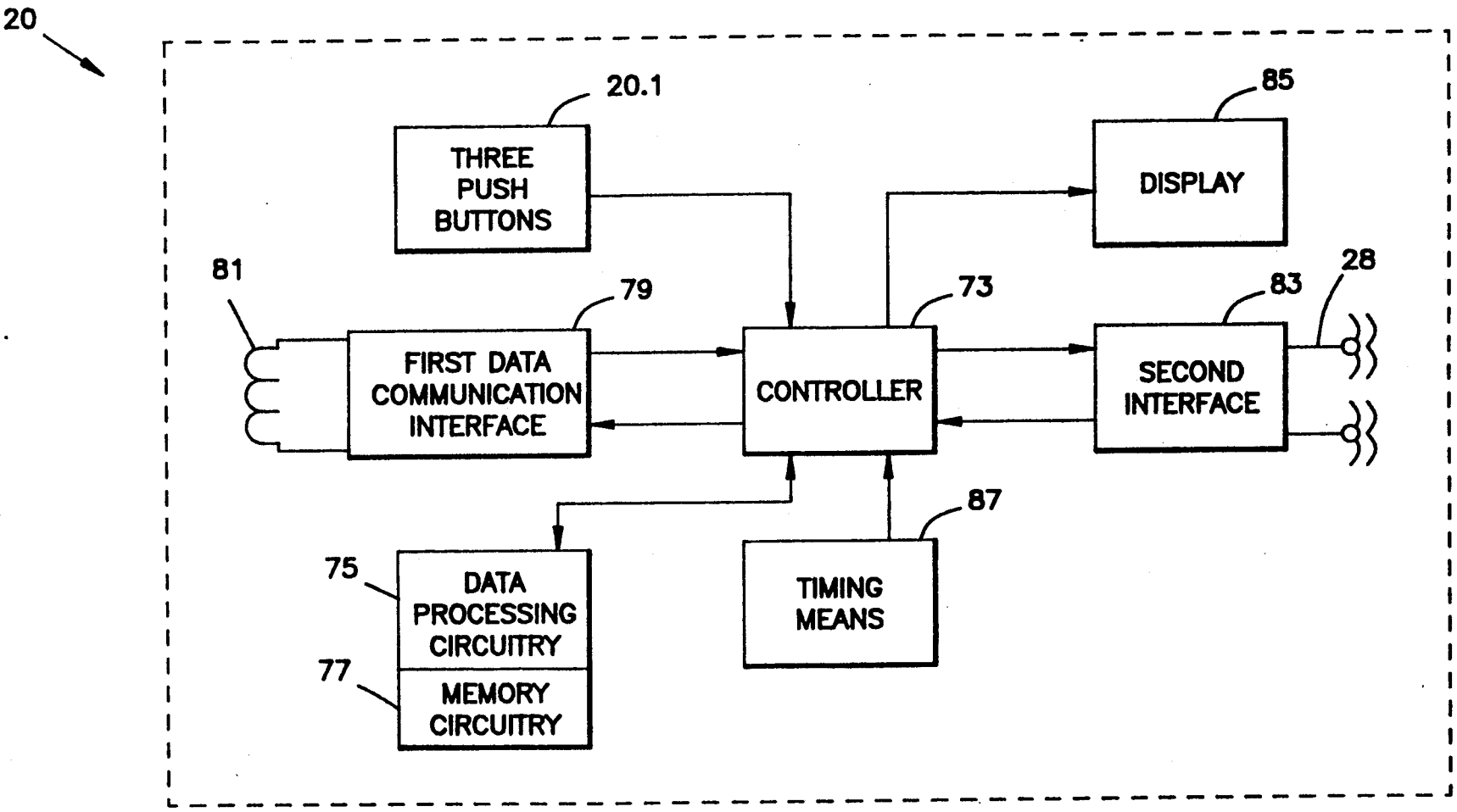
FIG. 8 is a block diagram of a control unit forming part of the apparatus according to the invention.

As shown in FIGS. 1 and 8, the control unit 20 comprises three push buttons 20.1 for manual actuation to cause the control unit 20 to transmit the PRIME, DISARM and INITIATE-commands respectively on loop 28. As shown in FIG. 8, The control unit 20 also comprises a controller 73, data processing circuitry 75 and associated memory circuitry 77. A first data communication interface 79 with coil 81 which, in use, is inductively coupled to coil 82 of programming tool 16, is connected to the controller 73. Also connected to controller 73 is a second interface 83 which, in use, is connectable to the conductor loop 28. A display 85 and timing means 87 are also connected to the controller 73.

In some embodiments the control unit 20 and the programming tool 16 may be housed in the same housing.

In use, the blasting site (not shown) is prepared by locating the charges 12.1 to 12.5 with their associated detonator arrangements 18.1 to 18.5 in selected positions.

Programming tool 16 is connected to master computer 14 via a bidirectional serial RS 232 communications link and first data interface 78 of the programming tool 16. Delay time data, relative to a common INITIATE-command, associated with each of the charges 12.1 to 12.5 is loaded from the master computer 14 into the programming tool 16 and is stored in the memory circuitry 76 of the programming tool 16. Data relating to a blast identification number is also programmed into the programming tool.

The programming tool 16 is then physically transported to each detonator arrangement 18.1 to 18.5, one after the other. By means of the coil 82 of the programming tool 16, C-shaped core 26 and twisted pair 22 a dedicated path is created between the programming tool 16 and each detonator arrangement individually, as illustrated in FIG. 1. The aforementioned delay time data relative to the common INITIATE-command signal for the selected detonator arrangement is then loaded via the path from the programming tool 16 into the detonator arrangements, one after the other.

Figure 9:
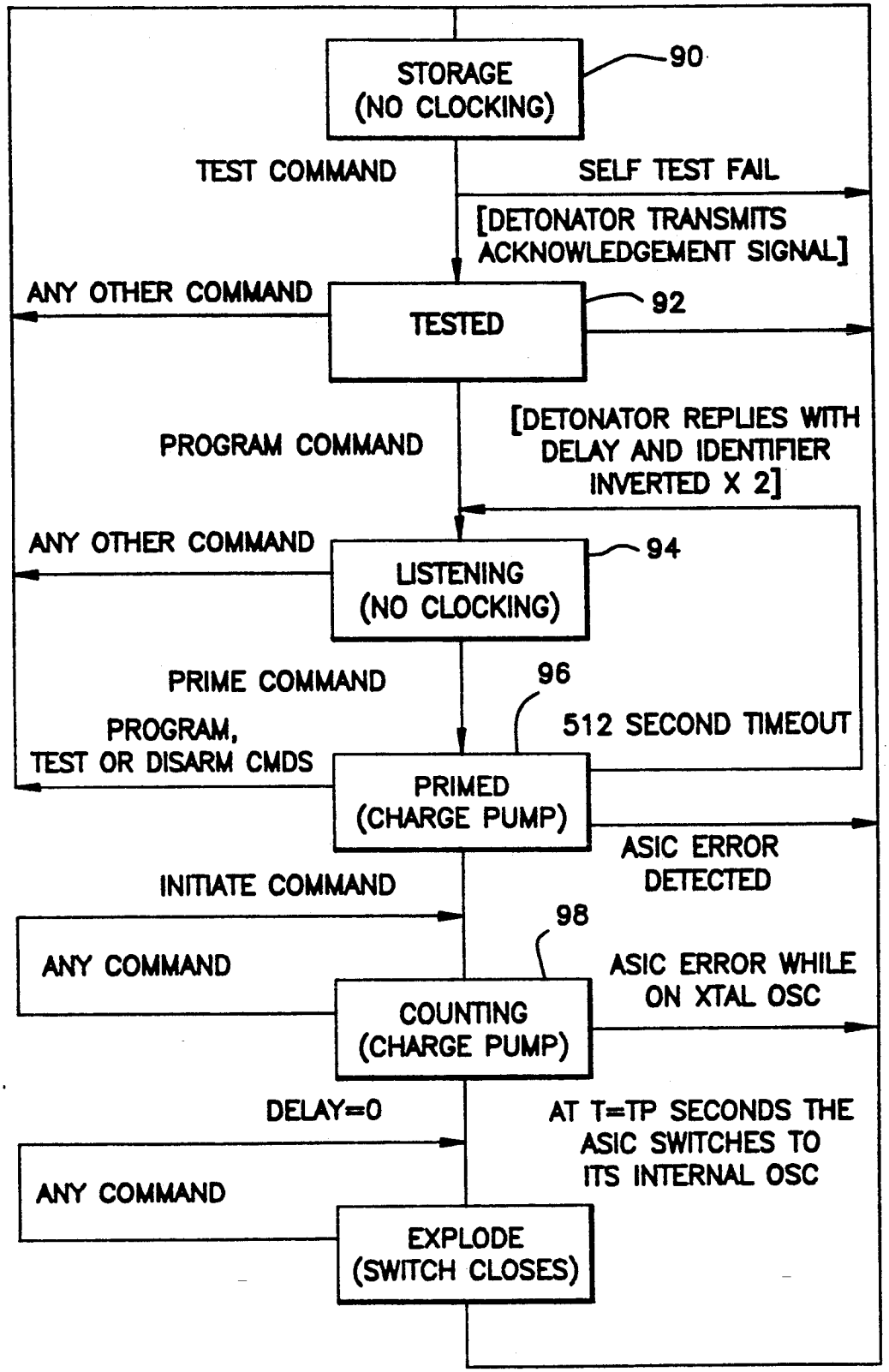
FIG. 9 is a state diagram of the detonator arrangement in FIG. 6.

As is illustrated in FIG. 9, the detonator arrangement is normally in a STORAGE-state 90. When connected to the programming tool 16, the first step is that a TEST-command signal is transmitted from the programming tool 16 to the selected detonator arrangement. The self test means 71 then initiates a self test and if successful, the detonator arrangement responds with an acknowledgement signal. The timing of the acknowledgement signal is used by the programming tool 16, to adjust the programmed delay time if necessary, in accordance with a deviation of the time base of the detonator arrangement. If the self test is successful, the detonator arrangement changes from the STORAGE-state to the TESTED-state at 92. If the self test is not successful, the detonator arrangement reverts to its normal STORAGE-state, shown at 90 in FIG. 9.

The programming tool 16 then transmits to the detonator arrangement a PROGRAM-command signal, blast identification data and the delay time data which are then loaded and stored in the detonator arrangement. The detonator arrangement repeats this data and the programming tool 16 verifies the correctness of the data stored. Upon successful completion of this step, the detonator arrangement changes to the LISTENING-state at 94.

With the detonator arrangements in the LISTENING-state, conductor 28 is passed through the gaps 26.1 defined in the C-shaped cores connected to the detonator arrangements. The loop is closed by connecting both ends of the conductor 28 to the control unit 20. The conductor 28 extending through a C-shaped core 26 is more clearly illustrated in FIG. 3. The detonator arrangements 18.1 to 18.5 now await a PRIME-command signal from the control unit 20.

Before transmission of the PRIME-command signal and/or the INITIATE-command signal, the control unit 20 transmits blast identification data to the detonator arrangements 18.1 to 18.5. The detonator arrangements compare this data to the blast identification data loaded into the detonator arrangements via the programming tool 16 during the programming step. Only if the blast identification data received from the control unit 20 and the blast identification data stored in the detonator arrangements correspond, will the detonator arrangements respond to the PRIME and/or INITIATE-commands. The blast identification data may also be loaded into the control unit via the programming tool 16, for subsequent transmission on the cable 28 as hereinbefore described.

Upon reception of the PRIME-command signal, the detonator arrangements change to a PRIMED-state, shown at 96 in FIG. 9. The charge pumps 32 are then caused to start charging the firing capacitors 34.

Up to this stage, the blast may be aborted by transmitting a DISARM-command signal from the control unit 20 to the detonator arrangements connected to conductor 28. This command is caused to be transmitted by manually actuating one of the three push buttons 20.1. If the self checking checker means 56 detects an error on the ASIC, the detonator is caused to revert to the STORAGE-state.

While in the PRIMED-state, the detonator arrangements await a common INITIATE-command signal from the control unit 20. If the INITIATE-command signal is not received within 512 seconds, all the detonator arrangements 18.1 to 18.5 revert to the LISTENING-state.

Upon reception of this signal, which is caused to be transmitted by manual actuation of an initiate push button on the control unit, the detonators enter a COUNTING-state 98 and start counting out their respective delays. In the means time the charge pumps 32 maintain the charge on the firing capacitors 34.

At tp seconds before the time of the explosion, the second oscillator 64 is caused to provide the time base signals for the timing function means 68 and delay counter register 70, instead of the crystal stabilized oscillator 60.

When the delay counter 70 of each detonator arrangement has counted out the stored delay, the first internal controller 52 causes output switch 36 to close, thereby to energize SCB 38 and to detonate its associated charge.

By loading data relating to progressively increasing time delays in subsequent detonator arrangements, a sequential train of explosions may be caused in the blast.

In some embodiments, data regarding the time of the multi-shot blast may be entered into the control unit 20 via the programming tool 16 by inductively coupling coils 81 and 82. A predetermined period before the blast time according to the timing means 87 of the control unit 20, the control unit automatically transmits the PRIME-command signal to the detonator arrangements and thereafter the INITIATE-command signal to cause the detonator arrangements to time out their respective delay times and to cause the charges 12.1 to 12.5 to explode.

In some embodiments the INITIATE-command signal transmitted to the detonator arrangements 18.1 to 18.5 may comprise a plurality, for example 16, unique signals. Each detonator arrangement is adapted to identify the signal to which it is responding to start timing out its delay time and to adapt the stored delay time to compensate for delays between the plurality of signals.

Figure 4:
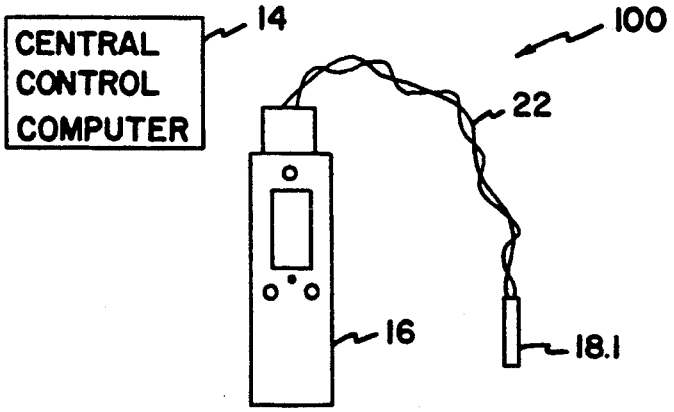
FIG. 4 is a schematic block diagram of part of a second embodiment of the apparatus according to the invention.
Figure 5:
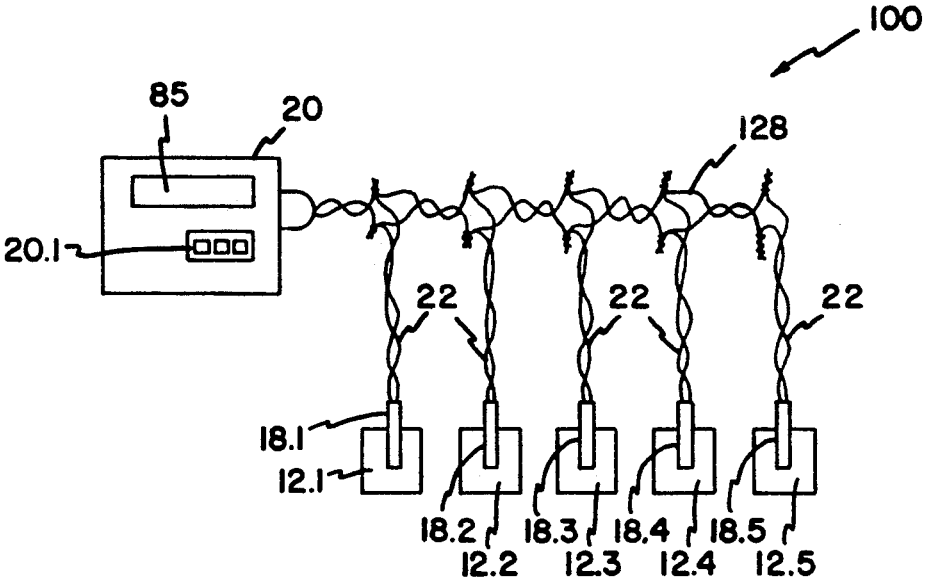
FIG. 5 is a schematic block diagram of the remainder of the apparatus of the second embodiment.

A second embodiment of the invention is generally designated by the reference numeral 100 in FIGS. 4 and 5. Parts or elements corresponding to the parts and/or elements in the first embodiment shown in FIGS. 1 and 2, are designated by like reference numerals.

The main difference between the system 10 of FIGS. 1 and 2 and the system 100 of FIGS. 4 and 5 is the connection of the detonator arrangements 18.1 to 18.5 to the control unit 20.

In the system 100 the twisted pairs 22 of the detonator arrangements 18.1 to 18.5 are connected galvanically to spaced, bare regions on a twisted pair 128 connected to the control unit 20.

The operation of the apparatus 100 is similar to that of the apparatus 10 shown in FIGS. 2 and 3.

It will be appreciated that there are many variations in detail on the apparatus and method according to the invention without departing from the scope and spirit of the appended claims.

We claim:

1. A method of timing and initiating a multi-shot blast using apparatus comprising a transportable electronic programming tool including data processing circuitry and memory circuitry; and a plurality of explosive charges, each said charge including an electronic detonator arrangement comprising timing means, memory circuitry and data processing circuitry; the programming tool and each said electronic detonator arrangement being provided with means via which a data communication path can be established between the programming tool and any one selected electronic detonator arrangement of said electronic detonator arrangements at a time, the method comprising the steps of:

preparing and positioning said plurality of explosive charges at a blast site;

loading into and storing in the memory circuitry to the programming tool data regarding a desired explosion time for each charge of said plurality of charges, the data regarding a desired explosion time comprising data regarding a delay time relative to an initiate command signal;

physically transporting the programming tool to each said charge;

establishing a data communication path between the programming tool and each said detonator arrangement individually, one after the other;

while the data communication path is established between the programming tool and a selected electronic detonator arrangement of said electronic detonator arrangements, programming the selected electronic detonator arrangement by loading time data comprising data regarding a delay time relative to the initiate command signal that will cause the electronic detonator arrangement to detonate the charge at the desired explosion time associated with that charge from the programming tool into the electronic detonator arrangement and storing said time data in the memory circuitry of the electronic detonator arrangement;

communicating a common initiate command signal to all of said electronic detonator arrangements; and causing each of said electronic detonator arrangements, in response to said initiate command signal, to commence processing the delay time data relative to the initiate command signal stored in its memory circuitry and to cause its associated charge to explode when, according to the electronic detonator arrangement's timing means and the delay time data the charge must explode.

2. A method as claimed in claim 1 wherein the step of loading and storing in the memory circuitry of the programming tool data regarding a desired explosion time for each charge of said plurality of charges comprises the step of connecting the programming tool to a central control computer and loading said data from the central computer into the programming tool.

3. A method as claimed in claim 1 wherein the step of establishing a data communication path between the programming tool and a selected electronic detonator arrangement comprises the step of inductively coupling said selected electronic detonator arrangement and said programming tool.

4. A method as claimed in claim 3 wherein while the data communication path is established between the programming tool and a selected electronic detonator arrangement, said selected detonator arrangement is caused to perform a self diagnostic test.

5. A method as claimed in claim 4 wherein if the said self diagnostic test is successful, the said selected electronic detonator arrangement transmits a response signal representative of a time base of the timing means of said selected electronic detonator arrangement to the programming tool; wherein the response signal is utilized by the programming tool to adapt said time data that will cause said selected electronic detonator arrangement to detonate its associated charge at the desired explosion time, to compensate for a variation in said time base; and wherein the adapted time data is loaded into and stored in said memory circuitry of said selected electronic detonator arrangement.

6. A method as claimed in claim 5 wherein, while the data communication path is established between the programming tool and a selected electronic detonator arrangement, the said selected detonator arrangement repeats said time data loaded and stored in its memory circuitry and wherein the programming tool verifies the correctness of said time data loaded and stored in the memory circuitry of said selected detonator arrangement.

7. A method as claimed in claim 6 wherein said plurality of detonator arrangements, once programmed, are connected to a control unit via a data communication cable and wherein said common initiate command signal is communicated by transmitting on the cable said common initiate command signal from the control unit.

8. A method as claimed in claim 7 wherein the common initiate command signal is transmitted by actuating a switch on the control unit.

9. A method as claimed in claim 7 wherein data regarding a desired time for the blast is loaded from the programming tool into the control unit and stored in the control unit; and wherein prior to said desired time for the blast, the control unit automatically transmits the common initiate command signal on the cable.

10. A method as claimed in claim 9 wherein the control unit transmits a prime command signal on the cable prior to the initiate command signal to cause, in each of said electronic detonator arrangements, power supply means to charge a firing capacitor.

11. A method as claimed in claim 10 wherein each of said plurality of electronic detonator arrangements, after it has processed the delay time data stored in its memory circuitry, causes a switch to close and charge on the firing capacitor to be dumped in a detonating device, thereby to cause its associated charge to explode.

12. A method as claimed in claim 11 wherein each of said plurality of electronic detonator arrangements comprises control circuitry for controlling its operation and wherein the control circuitry duplicates functions to improve reliability.

13. A method as claimed in claim 12 wherein while the data communication path is established between the programming tool and a selected electronic detonator arrangement, a resonant circuit is provided between the programming tool and said selected electronic detonator arrangement; wherein the programming tool induces a sinusoidal signal in the resonant circuit; and wherein data communication is effected by pulse width modulating said sinusoidal signal.

14. A method as claimed in claim 13 wherein the timing means of each of said plurality of electronic detonator arrangements comprises a crystal stabilized oscillator providing a first clock signal with a stabilized frequency and a second oscillator phase locked to the stabilized frequency, to provide a second clock signal; wherein initially the first clock signal is utilized in the processing of said delay time data and wherein at a predetermined time before the charge must explode, the second clock signal is utilized in the processing of said delay time data.

15. Apparatus for timing and initiating a plurality of explosive charges comprising:

a transportable electronic programming tool comprising data processing circuitry, memory circuitry and control circuitry, the tool being programmable to receive time data regarding desired times at which the charges must explode;

a plurality of electronic detonator arrangements, including one electronic detonator arrangement for each charge of said plurality of charges;

said programming tool and said plurality of electronic detonator arrangements being adapted so that a data communication path may be established between the programming tool and each electronic detonator arrangement of said plurality of electronic detonator arrangements individually, one after the other, for programming each electronic detonator arrangement by transferring from the programming tool to the selected electronic detonator arrangement time data regarding the desired time at which the selected electronic detonator arrangement must detonate its associated charge;

means for communicating a common initiate command signal to all of said electronic detonator arrangements; and each said electronic detonator arrangement comprising data processing circuitry, memory circuitry for storing the time data received from the programming tool, control circuitry and timing means; in use, each said detonator arrangement, after reception of said initiate command signal, being self-contained and adapted to detonate its associated charge when, according to the time data stored in its memory circuitry and its timing means, the charge must explode.

16. Apparatus as claimed in claim 15 comprising a central control computer wherein said time data regarding desired times at which the charges must explode is stored and wherein the programming tool is connectable to the central control computer to receive said time data.

17. Apparatus as claimed in claim 15 wherein the data path between the programming tool and a selected electronic detonator arrangement of said plurality of electronic detonator arrangements comprises an inductive coupling.

18. Apparatus as claimed in claim 15 wherein the means for communicating the common initiate command signal comprises a data communication cable connected to a control unit, and wherein said plurality of electronic detonator arrangements are connected to the data communication cable.

19. Apparatus as claimed in claim 18 wherein the said plurality of electronic detonator arrangements are inductively coupled to the data communication cable.

20. Apparatus as claimed in claim 19 wherein each of said plurality of electronic detonator arrangements comprises at least one battery, a charge pump and a firing capacitor, and wherein the control circuitry of each of said plurality of electronic detonator arrangements causes the at least one battery and charge pump to charge the firing capacitor in response to a prime command signal transmitted by the control unit prior to the initiate command signal.

21. Apparatus as claimed in claim 20 wherein the charge pump is adapted to charge the firing capacitor to a voltage higher than an output voltage of said at least one battery.

22. Apparatus as claimed in claim 21 wherein the control circuitry of each of said plurality of electronic detonator arrangements comprises first and second controllers; wherein the second controller duplicates functions performed by the first controller; and wherein checking means is provided which is sensitive to differences in functions performed by the first and second controllers and which, upon detection of a difference, generates a fault signal.

23. Apparatus as claimed in claim 22 wherein the timing means of each of said plurality of electronic detonator arrangements comprises a crystal stabilized oscillator providing a first clock signal with a stabilized frequency and a second oscillator phase locked to the frequency of the crystal stabilized oscillator, to provide a second clock signal; wherein initially the first clock signal is utilized to time out said delay time and wherein at a predetermined time before the electronic detonator arrangement must cause its associated charge to explode, the second clock signal is utilized to time out a remainder of said delay time.

24. Apparatus as claimed in claim 23 wherein each of said plurality of electronic detonator arrangements comprises a data communication interface connected to the control circuitry, the data communication interface comprising a resonant circuit including a capacitor and a coil which, in use, is inductively coupled to the programming tool.

25. Apparatus as claimed in claim 24 wherein data communication is effected by pulse width modulating a sinusoidal signal generated by the programming tool in said resonant circuit.

26. Apparatus as claimed in claim 25 wherein each electronic detonator arrangement comprises a detonating device for detonating its associated charge.

* * * * *